United States Patent [19]

Fabisiewicz et al.

[11] Patent Number: 4,838,429

[45] Date of Patent: Jun. 13, 1989

[54] FLEXIBLE THERMOPLASTIC POUCHES HAVING EASY-OPEN TEAR STRIP MEANS AND APPARATUS FOR MAKING SAME

[75] Inventors: Eugene Fabisiewicz, Mount Prospect; Jack R. Fagan, Lindenhurst, both of Ill.

[73] Assignee: Baxter International Inc., Deerfield, Ill.

[21] Appl. No.: 918,166

[22] Filed: Oct. 10, 1986

[51] Int. Cl.[4] ..... B65D 17/32

[52] U.S. Cl. ..... 206/605; 206/610; 206/632

[58] Field of Search ..... 206/605, 610, 632, 633, 206/439, 604; 229/123.1, 123.2

[56] References Cited

U.S. PATENT DOCUMENTS

| | | | |
|---|---|---|---|
| 1,981,440 | 11/1934 | Swift | 206/632 |
| 2,554,160 | 5/1951 | Von Guten | 206/633 |
| 2,991,000 | 7/1961 | Spees . | |
| 3,089,636 | 5/1963 | Swartz . | |
| 3,098,601 | 7/1963 | Anderson et al. | 206/605 |
| 3,175,752 | 3/1965 | Stabenow | 206/605 |
| 3,186,628 | 6/1965 | Rohde . | |
| 3,189,174 | 6/1965 | Cormack . | |
| 3,343,541 | 9/1967 | Bellamy, Jr. | 206/632 |
| 3,426,959 | 2/1969 | Lemelson | 206/605 |
| 3,442,436 | 5/1969 | Kirby, Jr. | 206/604 |
| 3,458,377 | 7/1969 | Lucas | 206/605 |
| 3,579,397 | 5/1971 | Schwarzkopf | 206/610 |
| 3,619,395 | 11/1971 | Skendzic | 206/633 |
| 3,625,270 | 12/1971 | Skendzic | 206/605 |
| 3,627,611 | 12/1971 | Bonk . | |
| 3,788,374 | 1/1974 | Saijo . | |
| 3,983,994 | 10/1976 | Wyslotsky . | |
| 4,226,330 | 10/1980 | Butler . | |
| 4,496,046 | 1/1985 | Stone et al. . | |
| 4,519,499 | 5/1985 | Stone et al. . | |

FOREIGN PATENT DOCUMENTS

| | | | |
|---|---|---|---|
| 0001094 | 3/1979 | European Pat. Off. | 229/123.2 |

*Primary Examiner*—Stephen P. Garbe

*Attorney, Agent, or Firm*—Paul C. Flattery; Mary R. Jankousky; Amy L. H. Rockwell

[57] ABSTRACT

A flexible thermoplastic pouch having an easy-open tear strip means secured thereto is provided. According to one embodiment of the present invention, a tear strip is secured to an imperforate sidewall of a flexible pouch along two sawtooth securement lines arranged generally in the shape of an ellipse. The point where the two securement lines converge is give a W-shape, which provides two points of high stress concentration. When the user grasps and pulls the tear strip means, the securement lines rupture precisely at these two points of stress concentration and continue along the sawtooth securement lines, thereby providing the pouch with a dispensing opening of predetermined size, shape, and location. A sealing die apparatus for forming sawtooth, notched lines of securement between the tear strip means and the flexible pouch is alos disclosed.

12 Claims, 2 Drawing Sheets

FLEXIBLE THERMOPLASTIC POUCHES HAVING EASY-OPEN TEAR STRIP MEANS AND APPARATUS FOR MAKING SAME

TECHNICAL FIELD

The present invention pertains to flexible thermoplastic pouches or containers, and more particularly to flexible thermoplastic pouches or containers having easy-open tear strip means to gain acces to the pouch's contents. The present invention also pertains to an apparatus for attaching easy-open tear strip means to flexible thermoplastic pouches or containers.

BACKGROUND OF THE INVENTION

Flexible thermoplastic pouches or containers are commonly used to package a wide variety of articles and products such as foodstuffs, beverages, medical instruments, and medical solutions. Thermoplastic sheet material is used in making such pouches because it exhibits good moisture barrier properties and is relatively easy to shape, form, fill, and seal.

Virtually all thermoplastic sheet material that is used in making flexible pouches or containers, whether blown, rolled, cast or die extruded, is directionally oriented to some degree. In addition, some thermoplastic sheet material is intentionally oriented by stretching either longitudinally, transversely, or both. Accordingly, it is relatively easy to open a thermoplastic pouch by tearing the thermoplastic sheet material in the direction of orientation. However, it is much more difficult to tear thermoplastic sheet material along a line that is transverse, angled, or curved relative to the material's orientation direction. Of course, one way of opening a thermoplastic pouch along a predetermined line is to use an implement such as a knife or scissors. However, such implements never seem to be readily available when needed, or must be sterile if the pouch and its contents are to remain in a sterile condition in those applications where sterility is essential, e.g., an operating room during a surgical procedure.

One known method of opening a thermoplastic pouch without using an implement is to tear the pouch along a score line or line of weakness that has been provided in the area where the pouch is intended to be opened. However, a score line is not entirely satisfactory because it weakens the pouch, thereby making it more likely to accidentally rupture along the line during transport and handling. In addition, the thermoplastic material is considerably thinner in the area of the score line, which severely detracts from the material's gas and moisture barrier properties.

One proposed alternative to using a score line or line of weakness to open a thermoplastic pouch is to provide the pouch with an opening that is covered with a patch or tear strip, an example of which is disclosed in U.S. Pat. No. 2,991,000 to Spees. As disclosed, an elongated hole or slot is first cut in one of the pouch's sidewalls, followed by covering the slot with a strip of thermoplastic material on the sidewall's interior surface, and a tear seal member on the sidewall's exterior surface. To open the pouch, the tear seal member is pulled away from the slot, which also tears away the portion of the interior strip covering the slot. While this type of "patch" system does provide a relatively easy way to open a thermoplastic pouch, the system has some serious drawbacks. First, the method of making such a pouch is relatively slow given the number of individual steps which must be performed. Second, handling, precisely registering, and sealing small individual strips of plastic material to a thermoplastic sheet is difficult, particularly in a high-speed manufacturing environment. Finally, it is difficult to obtain a reliable, liquid-tight seal between the slot and the patch.

One tear strip means for opening a thermoplastic pouch that is believed to be far superior to the Spees tear strip is disclosed in commonly assigned U.S. Pat. No. 4,496,046 to Stone et al., which is hereby incorporated herein by reference. In FIGS. 4 through 6 of Stone, there is illustrated a thermoplastic pouch having an easy-open tear strip sealed to one of the pouch's sidewalls. In direct contrast to Spees, Stone's tear strip does not cover a slot or opening in the pouch's sidewall; rather, a slot is created when the tear strip is pulled away from the pouch. Therefore, since the pouch is not initially provided with a slot that must be subsequently "patched," the pouch's moisture barrier and liquid containing capacity is greatly enhanced. In addition, the seal between the tear strip and the pouch does not have to be liquid-tight, which allows high-speed manufacturing parameters and tolerances to be much less critical than when a liquid-tight seal is required.

Despite the above-discussed advantages of the Stone tear strip and commercial success thereof, it has been found that it is sometimes difficult to initiate the separation of the tear strip from the pouch. In addition, the tear strip does not always separate from the pouch along the intended path, thereby resulting in an opening having an irregular and random shape. As expected, once the tear veers off course, it is difficult if not impossible for the operator to direct the tear back on track. It is believed that the plastic material's earlier-discussed orientation characteristics combined with an increased amount of plastic material in the area of the securement lines between the pouch and tear strip may be the primary causes of these problems.

In light of the above, a principal object of the present invention is to provide a flexible, thermoplastic pouch with easy-open tear strip means for opening the pouch, thereby eliminating the need to use an implement such as a knife or scissor.

Another principal object of the present invention is to provide a flexible, thermoplastic container with easy-open tear strip means without requiring an aperture or slot to be punched in the pouch's sidewall before the strip is applied thereto.

Another principal object of the present invention is to provide a thermoplastic pouch with tear strip means that will easily and readily separate from the pouch.

A further object of the present invention is to provide a thermoplastic pouch with an easy-open tear strip that will repeatedly separate from the pouch along a predetermined path to thereby create a dispensing opening of predetermined size and shape.

Another object of the present invention is to provide a thermoplastic pouch with an easy-open tear strip that will not reduce the pouch's strength, gas and moisture barrier properties, or liquid containing ability prior to opening.

A further object of the present invention is to provide a sealing die apparatus for attaching tear strip means to a flexible, thermoplastic pouch.

SUMMARY OF THE INVENTION

The present invention provides easy-open tear strip means for flexible thermoplastic pouches, bags, and containers. According to one embodiment of the present invention, a tear strip means is secured to an imperforate sidewall of a thermoplastic pouch along two sawtooth-shaped securement lines. The point of convergence between the securement lines is W-shaped, which provides two points of high stress concentration where the securement lines will precisely rupture when the tear strip means is lifted from the pouch's sidewall. As the tear strip means is further pulled, tear lines are formed precisely along the sawtooth-shaped securement lines, thereby forming a dispensing opening in the pouch's sidewall of predetermined size, shape, and location.

The present invention also provides sealing die apparatus for securing tear strip means to thermoplastic pouches and containers.

BRIEF DESCRIPTION OF THE DRAWINGS

While the specification concludes with claims that point out and distinctly claim the subject matter regarded as comprising the present invention, it is believed that the invention will be better understood from the following description and drawings in which:

DETAILED DESCRIPTION OF THE INVENTION

Figure 1:
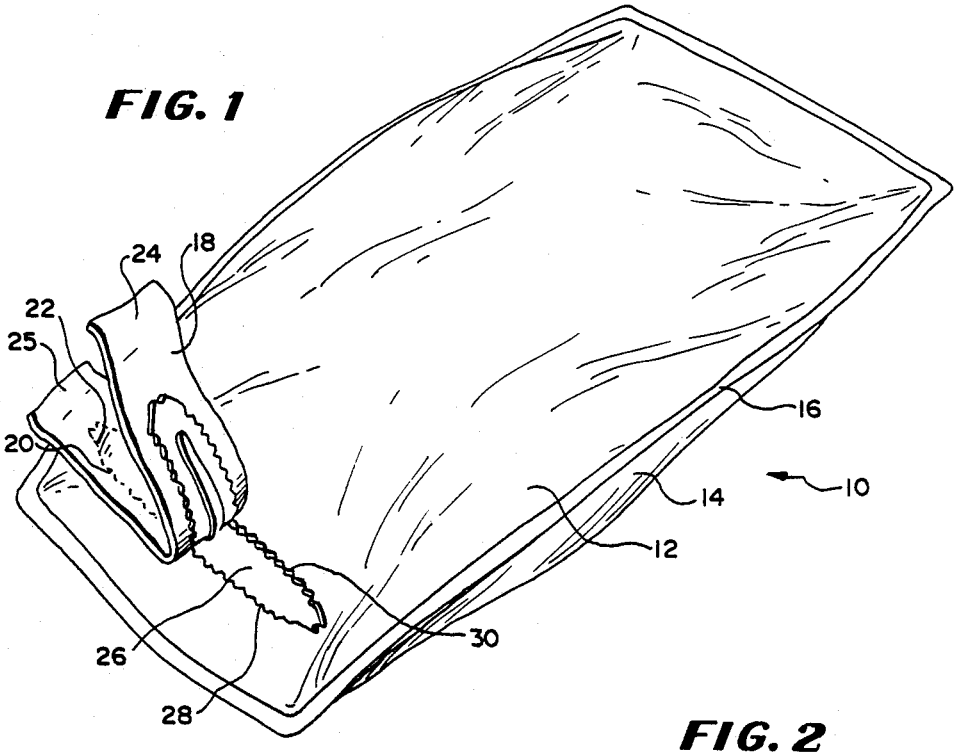
FIG. 1 is a perspective view of a preferred flexible thermoplastic pouch having an easy-open tear strip means shown partially removed from the pouch.

In the following detailed description of the present invention, the terms "pouch," "container," and "bag" are used synonymously throughout. In addition, the frame, transport means, energy source means, electrical wiring and the like which must necessarily be provided with respect to the functional members of the disclosed apparatus are not shown in the drawings or described in detail in order to simplify and more clearly disclose the present invention, it being understood that such details are well within the knowledge and experience of those skilled in the art of forming, filling, and sealing flexible thermoplastic containers.

Referring to FIG. 1, flexible thermoplastic pouch generally indicated as 10 includes first sidewall 12 and second sidewall 14 joined continuously at peripheral seal 16 by using suitable sealing method and apparatus. For example, seal 16 can be formed by using heat and pressure, radio frequency (RF), induction, a solvent, or an adhesive, the particular sealing technique being dependent on such factors as the type of thermoplastic material used, thickness of the material, the pouch's intended use, etc. Preferrably, pouch 10 is made by utilizing a high-speed apparatus that continuously brings two webs of thermoplastic material in juxtaposition, sealing a substantial portion of the webs' peripheral interface, filling the interior portion between the webs with product, and sealing the remainder of the webs' peripheral interface. Alternatively, pouch 10 can be made by folding a continuous web of thermoplastic sheet material into a tube over a forming mandrel, sealing the overlapping edges in a manner similar to that just described, and severing the tube into individual pouches.

Pouch 10 is useful in containing a wide variety of products that are intended for a corresponding wide variety of end uses. It has been found that pouch 10 is particularly well adapted for containing a material commonly referred to in the medical arts as "slush," which is a partially frozen mixture of normal saline and lactated ringer's solution used during various medical procudures such as open heart surgery. In such a setting where time is of the essence, it is crucial for pouch 10 to be provided with an easy and reliable means of gaining access to the slush without having to use an implement such as a knife or scissors.

Still referring to FIG. 1, tear strip means 18 is secured to sidewall 12 of pouch 10 along sawtooth-shaped securement lines 20 and 22, the significance of the sawtooth shape to be hereinafter described in detail. Tear strip means 18 has integral grasping tabs 24 and 25 that are unattached to sidewall 12 to facilitate easy grasping of tear strip means 18 by the user. It is particularly significant that tear strip means 18 does not initially cover and seal a pre-punched dispensing opening in sidewall 12. Rather, a dispensing opening 26 is formed in sidewall 12 when the user grasps tab 24 or 25 and lifts it away from and laterally across sidewall 12. Since tear away portion 12' of sidewall 12 is permanently attached to tear strip means 18 along securement lines 20 and 22, tear away portion 12' separates from sidewall 12 along tear lines 28 and 30, thereby forming dispensing opening 26.

Figure 2:
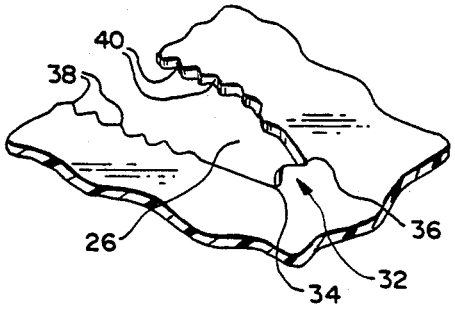
FIG. 2 is a fragmentary enlarged perspective view of the dispensing opening formed in the preferred flexible thermoplastic pouch of FIG. 1 after the easy-open tear strip means is removed therefrom.

Referring now to FIG. 2, which is an enlarged illustration of a portion of dispensing opening 26, point of convergence generally indicated as 32 between securement lines 20 and 22 before tear strip means 18 is removed from pouch 10 exhibits a generally W-shaped configuration. As noted in the Background portion of the present Specification, it is critical for tear lines 28 and 30 to be initiated at a precise location. Accordingly, the W-shape provides securement lines 20 and 22 with two points of high stress concentration 34 and 36, respectively. As further noted in the Background portion, once tear lines 28 and 30 are initiated, it is critical that they continue along a predetermined path instead of deviating therefrom so that a dispensing opening of predetermined size and shape is formed. Accordingly, by giving securement lines 20 and 22 the sawtooth shape as illustrated, the peaks and valleys thereof provide points of high stress concentration 38 amd 40 along which sidewall 12 will repeatedly and reliably separate, thereby creating dispensing opening 26 of predetermined size and shape.

Figure 3:
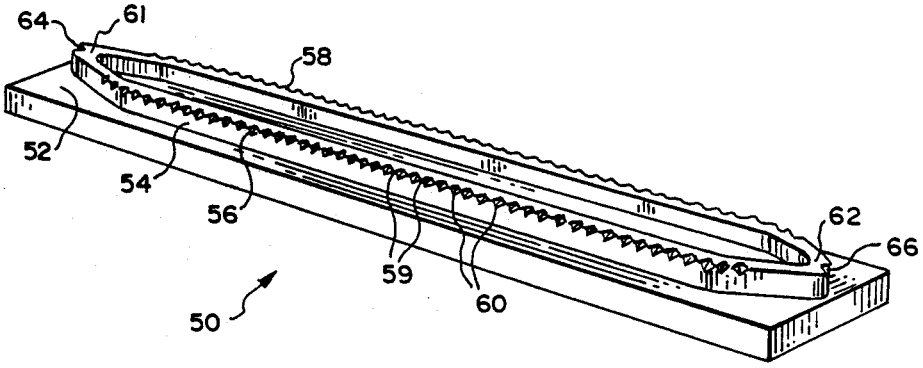
FIG. 3 is a perspective view of a sealing die apparatus used in attaching the easy-open tear strip means to the flexible thermoplastic pouch illustrated in FIG. 1.

Referring now to FIG. 3, there is illustrated a sealing die apparatus generally indicated as 50 that is used in attaching tear strip means 18 to sidewall 12 of flexible pouch 10 illustrated in FIG. 1. In FIG. 3, sealing die apparatus 50 includes flat plate 52 having a raised boss 54 projecting therefrom. Boss 54 is approximately the same size and shape as dispensing opening 26 to be formed in sidewall 12 of pouch 10. The outer peripheral edges 56 and 58 of boss 54 are provided with peaks and valleys 59 and 60 (sawtoothed), which correspond to the peaks and valleys 38 and 40, respectively, formed in sidewall 12 of pouch 10 when tear strip means 18 is removed therefrom. Opposed end tips 61 and 62 are provided with V-shaped notches 64 and 66, respectively, which form W-shaped point of convergence 32 and corresponding points of high stress concentrations 34 and 36 where securement lines 20 and 22 rupture when tear strip means 18 is removed from sidewall 12 of pouch 10.

Sealing die apparatus 50 is particularly well adapted for use with a radio frequency (RF) sealing apparatus. RF is generally limited to polor materials because of the nature of the heating mechanism, which involves friction generated by molecular dipole orientation in the field of the alternating high-frequency current. For this reason, some non-polar materials such as polyethylene are not suited to this method and would require sealing die 50 to be used with a conventional heat and pressure sealing aparatus. RF thermoplastic materials include polyvinyl chloride (PVC), ethylene vinyl acetate (EVA), and saran.

As will be appreciated by those skilled in the art, a wide variety of thermoplastic films that satisfy the definition of "flexible" can be utilized in practicing the present invention. For example only, it has been found that a good film for sidewalls 12 and 14 of pouch 10 is 15 mil (0.015 inch) polyvinyl chloride (PVC). A good film for tear strip means 18 is a 20 mil (0.020 inch) PVC. Since PVC is a polar thermoplastic material, RF is well suited for attaching tear strip means 18 to pouch 10. For the film examples given, a 1.5 SBT Callanan RF generator set at 0.16 to 0.21 millilamps at a seal pressure of 65 to 75 PSI and held for a seal time for approximately 1.5 seconds produce particularly good securement lines 20 and 22 between tear strip means 18 and sidewall 12 of pouch 10.

Figure 4:
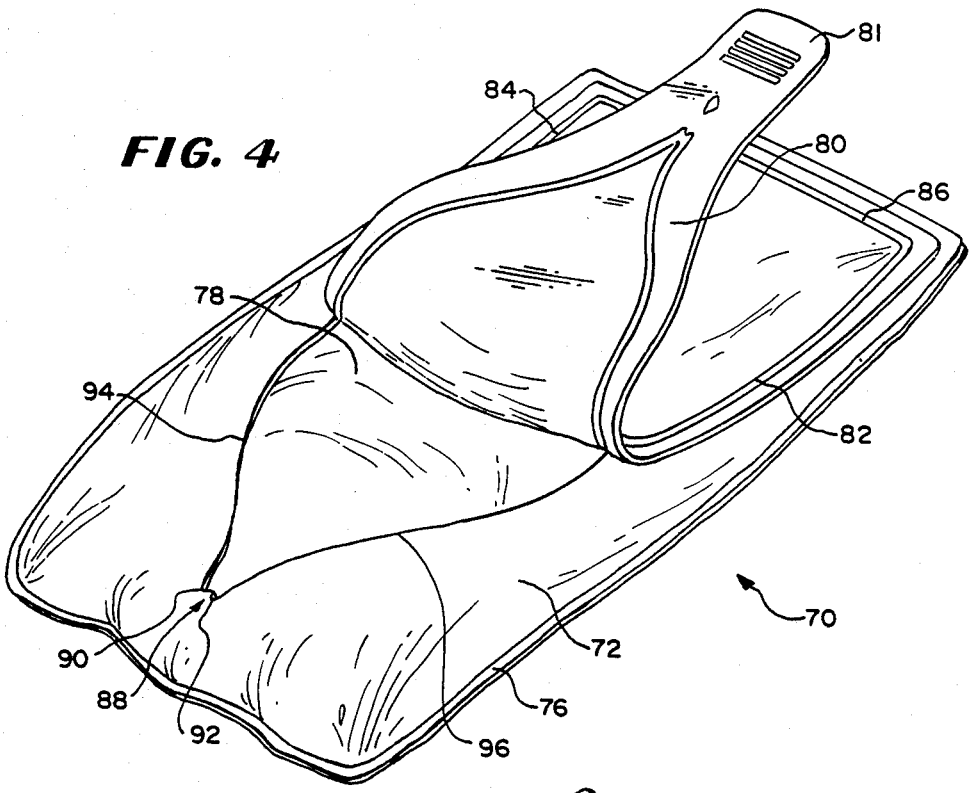
FIG. 4 is a perspective view of another preferred flexible thermoplastic pouch having an easy-open tear strip means partially removed from the pouch.

FIG. 4 illustrates another particularly preferred flexible thermoplastic pouch generally indicated as 70. In FIG. 4, pouch 70 includes first sidewall 72 and second sidewall 74 (not shown) joined continuously at peripheral seal 76 by using a suitable sealing method and apparatus. First sidewall 72 is provided with a pre-punched wishbone or chevron-shaped opening 78 that is initially covered with a slightly larger, complimentary-shaped tear strip means 80, which is shown partially removed from first sidewall 72. Tear strip means 80 is sealed to the outer surface of first sidewall 72 along securement lines 82, 84 and 86. Since pouch 70 is initially provided with opening 78 and is generally not intended to contain a liquid, but rather contain a solid or act as an overpouch, securement lines 82, 84, and 86 are generally smooth and of substantially constant cross-section rather than having a sawtooth configuration. Of course, opening 78 in sidewall 72 could be eliminated with sidewall 72 having tear strip means 80 attached thereto in a manner substantially similar to tear stip means 18 of pouch 10 of FIG. 1. In such a case, seal lines 82, 84, and 86 would preferrably have a sawtooth configuration to facilitate precise tearing and easy removal to form an opening of predetermined size and shape.

Still referring to FIG. 4, point of convergence generally indicatd as 88 between securement lines 82 and 84 before tear strip means 80 is removed from pouch 70 exhibits a W-shaped configuration. As with point of convergence 32 of pouch 10 in FIG. 1, the W-shape of point of convergence 88 provides two points of high stress concentration 90 and 92. Thus, when a user grasps and pulls upwardly on tab 81, securement lines 82 and 84 between sidewall 72 and tear strip means 80 will rupture precisely at points 90 and 92. Then, as the user pulls tear strip means 80 longitudinally across pouch 70, tear lines 94 and 96 are formed along a precise and predetermined path.

Figure 5:
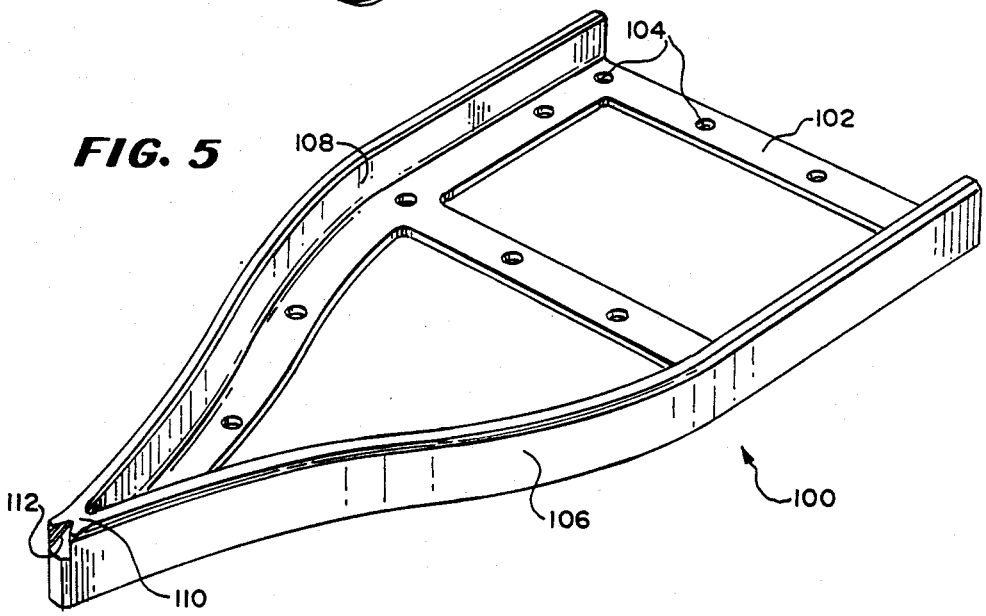
FIG. 5 is a perspective view of another preferred sealing die apparatus used in attaching the easy-open tear strip means to the flexible thermoplastic pouch illustrated in FIG. 4.

Referring now to FIG. 5, a sealing die apparatus generally indicated as 100 can be used in attaching tear strip means 80 to sidewall 72 of pouch 70 illustrated in FIG. 4. In FIG. 5, sealing die apparatus 100 includes flat plate 102 having a plurality of fastener receiving holes 104 therein, and raised bosses 106 and 108 projecting therefrom. Point of convergence or base tip generally indicated as 110 between raised bosses 106 and 108 is provided with a generally V-shaped notch 112, which forms W-shaped point of convergence 88 and point of high stress concentration 90 and 92 when tear strip means 80 is attached to sidewall 72 of pouch 70.

As with sealing die apparatus 50 illustrated in FIG. 3, sealing die apparatus 100 illustrated in FIG. 5 is particularly well adapted to be used with a RF sealing apparatus. In such case, pouch 70 is preferrably made of a dipole thermoplastic material such as PVC. For example, it has been found that a 15 mil (0.015 inch) PVC sheet material is particularly preferred for sidewalls 72 and 74 of pouch 70. It has also been found that a 20 mil (0.020 inch) PVC material is preferred for tear strip means 80. In sealing such a tear strip means 80 to sidewall 72, a Thermatron generator type F10-25 set at 0.65 to 0.85 amps and pressure of 80 to 100 PSI with a seal time of approximately 2.5 seconds produces satisfactory securement lines 82, 84 and 86 between tear strip means 80 and sidewall 72 of pouch 70.

While several embodiments and features of the present invention have been described in detail and shown in the accompanying drawings, it will be evident to those skilled in the art that various modifications and additions are possible, none of which entails a departure from the spirit and scope of the present invention. Accordingly, the following claims are intended to embrace such modifications and additions.

What is claimed is:

1. A flexible thermoplastic pouch comprising:

(a) an imperforate first sidewall having an outer surface and an inner peripheral edge;

(b) a second sidewall having an inner peripheral edge continuously sealed to said inner peripheral edge of said first sidewall;

(c) tear strip secured to said outer surface of said imperforate first sidewall along at least two securement lines having a substantially W-shaped area of convergence, thereby providing two points of high stress concentration, said tear strip having a single grasping tab connected to both points of high stress concentration; and (d) whereby intitial manual separation of said single grasping tab from said outer surface of said imperforate first sidewall will rupture at said two points of high stress concentration, and subsequent manual separation of said tear strip from said imperforate sidewall will tear said first sidewall along said securement lines, thereby providing said pouch with a dispensing opening of predetermined size and shape.

2. The flexible thermoplastic pouch recited in claim 1 wherein said at least two securement lines between said tear strip and said imperforate first sidewall of said pouch are substantially sawtooth-shaped.

3. The flexible thermoplastic pouch recited in claim 1 wherein said at least two securement lines between said tear strip and said imperforate first sidewall of said pouch define a substantially elliptical area.

4. The flexible thermoplastic pouch recited in claim 1 wherein said tear strip comprises a substantially flat strip of thermoplastic material having opposite end portions.

5. The flexible thermoplastic pouch recited in claim 4 wherein at least one of said opposite end portions of said flat strip of thermoplastic material is not secured to said imperforate first sidewall of said flexible pouch, thereby providing said grasping tab.

6. The flexible thermoplstic pouch recited in claim 4 wherein said substantially flat strip of thermoplastic material is selected from the group consisting of polyvinyl chloride, ethylene vinyl acetate, and saran.

7. The flexible thermoplastic pouch recited in claim 1 wherein said imperforate first sidewall and said second sidewall are made from thermoplastic sheet material selected from the group consisting of polyvinyl chloride, ethylene vinyl acetate, and saran.

8. The flexible thermoplastic pouch recited in claim 1 wherein said pouch contains a mixture of saline and lactated ringer's solution.

9. A flexible thermoplastic pouch comprising:

(a) a first sidewall having an outer surface, an inner peripheral edge, and a pre-punched opening therein;

(b) a second sidewall having an inner peripheral edge continuously sealed to said inner peripheral edge of said first sidewall;

(c) a tear strip secured to said outer surface of said first sidewall along at least two securement lines and covering said pre-punched opening in said first sidewall, said securement lines having a substantially W-shaped area of convergence, thereby providing two points of high stress concentration, said tear strip having a single grasping tab connected to both points of high stress concentration; and (d) whereby initial manual separation of said single grasping tab from said outer surface of said first sidewall will rupture at said two points of high stress concentration, and subsequent manual separation of said tear strip from said first sidewall will tear said securement lines, thereby uncovering said pre-punched opening in said first sidewall of said pouch.

10. The flexible thermoplastic pouch recited in claim 9 wherein said at least two securement lines between said tear strip and said first sidewall of said pouch are substantially sawtooth-shaped.

11. The flexible thermoplastic pouch recited in claim 9 wherein said at least two securement lines between said tear strip and said first sidewall of said pouch define a substantially elliptical area.

12. The flexible thermoplastic pouch recited in claim 1 wherein said securement lines are radio frequency seals between said tear strip and said first sidewall.

* * * * *